United States Patent [19]

Bush

[11] 4,350,290

[45] Sep. 21, 1982

[54] RESILIENT RAIL FASTENER ASSEMBLY FOR CURVED TRACK

[75] Inventor: Charles J. Bush, Woodridge, N.J.

[73] Assignee: New York City Transit Authority, Brooklyn, N.Y.

[21] Appl. No.: 132,895

[22] Filed: Mar. 24, 1980

[51] Int. Cl.[3] ..... E01B 5/18

[52] U.S. Cl. ..... 238/17; 238/20; 238/22; 238/293; 238/336

[58] Field of Search ..... 238/15, 17–23, 238/282, 292, 293, 310, 334, 336, 337, 361

[56] References Cited

U.S. PATENT DOCUMENTS

| | | | |
|---|---|---|---|
| 1,149,307 | 8/1915 | Thomas | 238/20 |
| 1,163,816 | 12/1915 | Forsyth | 238/20 |
| 1,224,078 | 4/1917 | Crum | 238/292 |
| 1,439,090 | 12/1922 | Gallagher | 238/19 |
| 2,101,313 | 12/1937 | Gillispie | 238/292 X |
| 3,819,114 | 6/1974 | Bush | 238/282 X |
| 3,964,679 | 6/1976 | Frank | 238/17 |

*Primary Examiner*—Randolph A. Reese
*Attorney, Agent, or Firm*—Anthony J. Casella

[57] ABSTRACT

A resilient rail fastener assembly for curved tracks includes a unitary base plate adapted to receive a load carrying rail which includes a pair of planar brace plates for maintaining the rail in a vertical orientation and reducing noise and vibration. More particularly, the rail fastener assembly includes a unitary base plate having an upstanding shoulder disposed on one side thereof, and a pair of spaced, planar upstanding brace plates disposed on the other side thereof and formed integrally with the base plate. An elastomeric pad is positioned between the base plate and the bottom of the rail, with the brace plates being disposed transverse to the longitudinal axis of the rail. The upper portion of each brace plate is disposed in abutting relationship with the upper portion of the rail. By this arrangement, centrifugal forces imparted to the curved rail by the movement of rolling stock, are transferred from the rail, through the brace plates and the base plate, and into the road bed, thereby maintaining the rail in a vertical orientation and reducing unwanted noise and vibration. In an alternative embodiment of the subject invention, a parallel guard rail is mounted between the load carrying rail and the brace plates. In the latter embodiment, the rail fastener assembly further includes a wedge which is fixedly connected to the base plate and interposed between the brace plates and the guard rail, with the wedge abutting the upper portion of the guard rail. By this arrangement, the centrifugal forces imparted to the guard rail by the rolling stock are transferred from the guard rail through the wedge and brace plates into the ground thereby maintaining the guard rail in a vertical orientation.

5 Claims, 6 Drawing Figures

RESILIENT RAIL FASTENER ASSEMBLY FOR CURVED TRACK

BACKGROUND OF THE INVENTION

The subject invention provides for new and improved resilient rail fastener assemblies for fastening rails on curved tracks. The rail fastener assembly includes a unitary base plate having an upstanding resilient seat retaining shoulder disposed on one end of the base, and a pair of spaced, generally planar parallel upstanding rail brace plates welded to the base plate, on the opposed end thereof. The load carrying rail is received in the base with an elastomeric pad interposed between the rail and the base with the pad acting as a resilient seat. In a single superelevated rail installation, the brace plates are disposed in abutting relationship with the upper portion of the rail such that centrifugal forces imparted to the rail by rolling stock are transferred from the rail through the brace plates and into the road bed. In an alternative embodiment, wherein a guard rail is mounted within the brace plate parallel to the load carrying rail, the rail fastener assembly further includes a wedge interposed between the brace plates and the guard rail to transfer centrifugal forces from the guard rail thereby maintaining the guard rail, in a vertical orientation. In addition, the wedge affords increased simplicity, and versatility and facilitates track installation.

In the prior art, numerous rail fastener assemblies have been devised for supporting the rails of a railway system. Some of these fasteners are used in conjunction with cross ties while others are of the direct fixation type which may be connected directly to the track bed. In either type construction, the rail track fastener is subjected to relatively high stresses as heavy loads of rolling stock pass along the rails. More specifically, as the rolling stock travels along the rails, the rails and rail fasteners are subjected to repeated poundings causing the rails to flex under the moving loads. In order to alleviate the stresses developed by the rolling stock, resilient rail fastener assemblies have been developed which permit the assembly to flex under stress. An example of a resilient rail track fastener may be found in U.S. Pat. No. 3,945,566 to Bush, and assigned to the same assignee as the subject invention. In the Bush patent, the fastener is provided with an elastomeric pad which is interposed between the rail and the base plate creating a degree of flexibility in the fastener to absorb the stresses induced by the rolling stock.

Another problem associated with rail maintenance, concerns the centrifugal forces imparted to the rail on a curved section of track. More specifically, as rolling stock is guided around a curved portion of the rail, the inertia developed by the rolling stock exerts centrifugal forces directed perpendicular to the longitudinal axis of the rail which tends to cause the rail to bend or shift out of a vertical orientation. These recurring forces placed on the rails by each wheel of the rolling stock, generates vibrations in the rails and the fastener assemblies creating noisy operations. Further, the centrifugal forces on the rail, in combination with the vibrations produced by the rolling stock, tend to cause the connections in the fastener assembly to loosen, necessitating frequent readjustment or repair thus rendering the tracks unstable for safe operations. As can be appreciated, increased noise in urban environments is clearly objectionable, and increased maintenance and down time is equally undesirable.

Certain rail fastener assemblies found in the prior art have been designed to alleviate noise, vibration and the centrifugal forces imparted to the rail. For example, in the above cited patent to Bush, a single brace member, connected to a spring plate, which is in turn bolted to the rail fastener assembly, is provided to inhibit the side motion or overturning of the rail. A similar brace member is disclosed in U.S. Pat. No. 3,819,114, to Bush and assigned to the same assignee as the subject invention. The braces disclosed in the above cited patents are contoured to the shape of the rail, and in addition, are welded to elements which are in turn bolted to the base plate. The bolt connections between brace members and the base plates frequently loosen allowing the braces to shift. These prior art fastener assemblies were effective in reducing the overturning of rails under the force of the rolling stock. However, it is desirable to provide less complex rail track fastener assembly which provides rigid resistance to the centrifugal forces created by the rolling stock, and in addition, simplifies rail replacement and reduces time for such replacement. Further, it is desirable to provide a rail track fastener assembly which includes a wedge means to provide rigid support in a low guarded rail assembly to prevent the guard rail from overturning under the centrifugal forces of the rolling stock.

Accordingly, it is an object of the subject invention to provide a new and improved rail fastener assembly for curved track which provides superior resistance to centrifugal forces imparted to the rail by the rolling stock.

It is a further object of the subject invention to provide a resilient rail fastener assembly which is operative to reduce unwanted noise and vibration.

It is another object of the subject invention to provide a new and improved rail fastener assembly which is simple and facilitates rail installation and replacement.

SUMMARY OF THE INVENTION

In accordance with the above described objects, a resilient rail fastener assembly is provided which includes a unitary base plate that is adapted to receive the load carrying superelevated curved rail. The base of this assembly includes a planar base portion, an upstanding shoulder disposed at one end of the base portion, and a pair of spaced, generally planar upstanding brace plates disposed at the opposed end of the base portion. An elastomeric pad, for cushioning the rail, is positioned between the upper surface of the base portion of the base plate and the bottom of the curved rail. The parallel planar brace plates which are formed integrally with the base portion are disposed such that the upper portions thereof are in abutting relationship with the upper portion or head of the rail. By this arrangement, centrifugal forces imparted to the superelevated curved rail by the rolling stock moving therealong are transferred from the rail, through the brace plates and into the base portion of the base plate, thereby maintaining the load carrying rail in a vertical orientation while permitting the rail to flex in the vertical direction thereby reducing unwanted noise and vibration.

An alternative embodiment of the subject invention is adapted to be used in conjunction with the paired, load carrying and guard rails common in curved track installations. The low or non-superelevated rail in a curved track installation is generally paired with an inner guard rail for guiding the wheels around the curve to prevent the wheels of the rolling stock from becoming derailed. The guard rail is disposed in parallel relationship to the load carrying rail and is seated in an extension of the planar base portion of the base plate. In the latter embodiment of the subject invention, the rail fastener assembly further includes a wedge which is interposed between the brace plates and the head or ball portion of the guard rail. More specifically, the wedge includes a vertical portion which is disposed between the brace plates and the rail head, and a horizontal portion which is disposed between the pair of brace plates, and is bolted to the base plate. The combination of the wedge and the brace plates functions to rigidly maintain the guard rail in a vertical orientation. Further, since the wedge is bolted to the base plate it may be removed permitting the replacement of the guard rail independent of the load carrying rail. In addition, the use of the wedge permits the assembly to be adjusted without the use of shims.

DETAILED DESCRIPTION OF THE PREFERRED EMBODIMENTS

Figure 1:
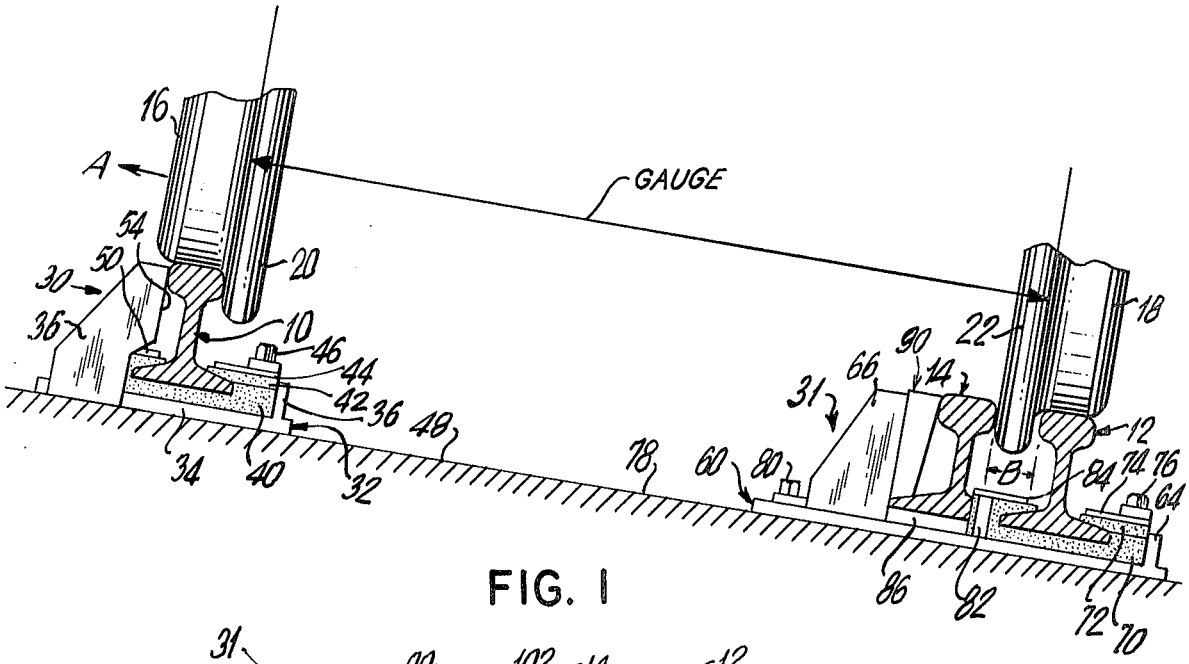
FIG. 1 is an elevational view, partially in section of a curved track installation with the outside rail being superelevated and illustrates a superelevated rail assembly on the left and a guarded low rail assembly on the right, as used in a curved track installation, and depicts two embodiments of the new and improved resilient rail fastener assembly of the subject invention.

Referring to FIG. 1, a pair of rail fastener assemblies for curved track are shown and include on the left, an assembly 30 for use in conjunction with the superelevated load carrying rail 10, and on the right, a rail fastener assembly 31 for use in conjunction with the low, load carrying rail 12 and a guard rail 14. Wheels 16 and 18 of the rolling stock (not shown) ride on the load carrying rails 10 and 12 with the spacing between the wheels 16, 18 defining the wheel gauge. In a typical curved track installation, as illustrated in FIG. 1, the curvature of the inner rails 12, 14 is greater than the curvature of the superelevated rail 10, such that rolling stock, moving towards the viewer and out of the plane of the drawing, will be guided to the right. As the rolling stock negotiates the curve, centrifugal forces are generated in the direction of arrow A, opposite the direction of the turn. One obvious method of inhibiting derailments includes adding a slope to the track bed, as illustrated in FIG. 1, with the outer rail being superelevated, much the same as a highway is banked at a curve.

As can be appreciated, the centrifugal forces generated by the rolling stock are transmitted to the rails. More particularly, the flange portion 20 of wheel 16 imparts centrifugal forces to the head of load carrying rail 10 in the direction indicated by arrow A, which can cause the overturning of the rail. In contrast, the flange 22 of wheel 18 does not bear on the load carrying inner rail 12, in a curved track situation. Rather, the wheel tends to be forced in the direction of arrow A away from the load carrying rail 12. Accordingly, with sections of curved track, a guard rail 14 is installed, parallel to the load carrying rail 12, which inhibits the lateral shifting of the wheel 18 thereby preventing its derailment. The guard rail 14 is spaced from the load carrying rail 12 a distance B which is referred to as the flangeway. Similar to the superelevated rail assembly, the flange 22 of wheel 18 imparts a centrifugal force to the head of the guard rail 14 tending it to cause it to overturn.

In accordance with the subject invention, a new and improved means is provided for retaining the rails 10 and 14 in a vertical orientation by transferring the centrifugal force from the rails into the rail fastener assemblies. The resilient rail fastener assembly of the subject invention is operative to dissipate vibrations through an elastomeric seat and is integral and rigid in construction to prevent side movements of the rail.

Figure 4:
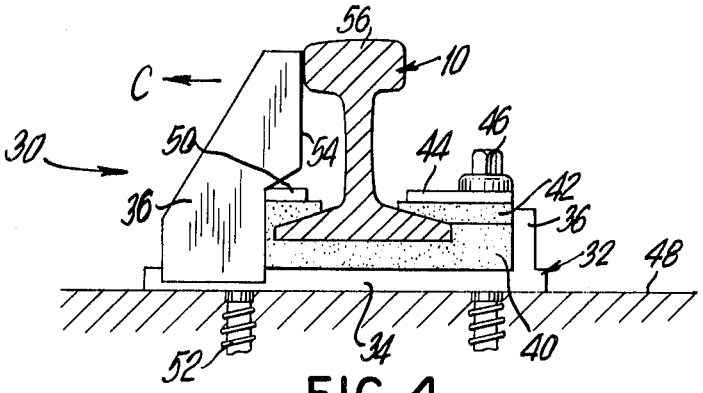
FIG. 4 is a side elevational view, partially in section, of the superelevated rail fastener assembly of the subject invention, as used with a superelevated rail.
Figure 5:
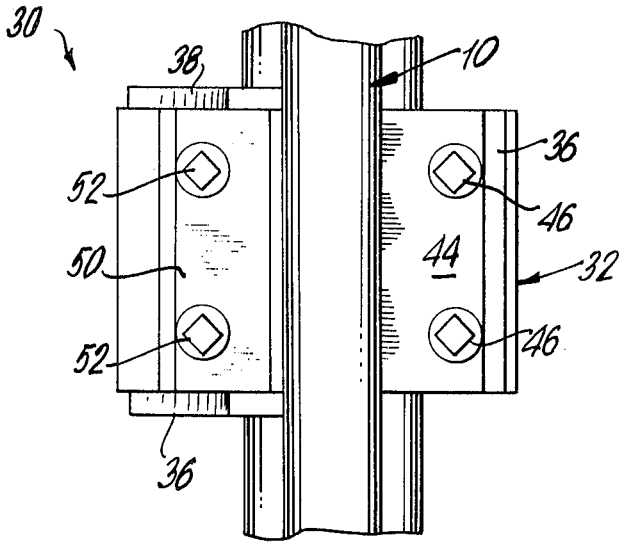
FIG. 5 is a top view of the rail fastener assembly of the subject invention as illustrated in FIG. 4.

A first embodiment of the subject invention for use in conjunction with the single superelevated rail 10 is more specifically illustrated in FIGS. 4 and 5. The rail fastener assembly 30 includes a unitary base plate 32 consisting of a planar base portion 34 and an upstanding, elastomeric pad retaining, vertical, shoulder 36 disposed at one end of the base portion 34. The assembly 30 further includes a pair of planar brace plates 36 and 38 which are disposed at the opposed end of the base portion 34. The brace plates 36, 38 may be formed integrally with the base portion 34 or welded thereto to provide a single rigid unit. By this arrangement, the rigidity of the bracing elements in the assembly is assured thereby significantly improving the effectiveness of the fasteners.

The rail fastener assembly further includes an elastomeric rail seat or pad 40 disposed between the upper surface of the base portion 34 and the bottom of the rail 10. The rail seat 40 is formed from a material, such as rubber or neoprene which is not subject to disintegration from oil or other petro-chemical derivatives. The rubber seat 40 is approximately $\frac{3}{4}$ of an inch thick and is provided with breather holes or air compartments (not shown) to aid in the dissipation of vibration by proving a degree of resilience under the rail.

After the rail 10 is mounted in the rubber seat 40 and base plate 32, it is thereafter secured in place. More specifically, an end corner plate 42 is placed over the right hand portion of the base of the rail 10 between the rail and the shoulder 36. A stiffener plate 44 formed from a rigid material such as steel is placed over the end corner plate 42 and a pair of lag screws 46, of approximately 7 inches in length, are secured through the stiffener plate 44, end corner plate 42 and the base plate 32 into the substrate 48. The substrate 48 may be, for example, wooden cross ties, installed in stone ballast or concrete, or concrete cross ties, steel ties or decks. In the alternative, the assembly 30 may be directly affixed to the road bed via concrete slabs or pads.

The other side of the rail is secured by steel stiffener plate 50 which is bolted into the substrate 48 by a pair of lag screws 52. As illustrated in FIG. 4, the brace plates 36 and 38 are disposed such that a planar vertical edge 54 thereof is in abutting relationship with the head or ball portion 56 of rail 10. By this arrangement, the brace plates 36, 38 absorb the centrifugal forces imparted by the rolling stock to the rail 10 in the direction indicated by arrow C, in FIG. 4. More specifically, the centrifugal forces are absorbed through the brace plates 36, 38 and are transmitted to the planar base portion 34 and into the substrate 48. It has been found that the spaced, parallel vertical brace plates 36, 38 which are formed integrally with the rail fastener assembly 32 provide absolute rigidity against centrifugal forces which would tend to cause the rail to overturn.

Figure 2:
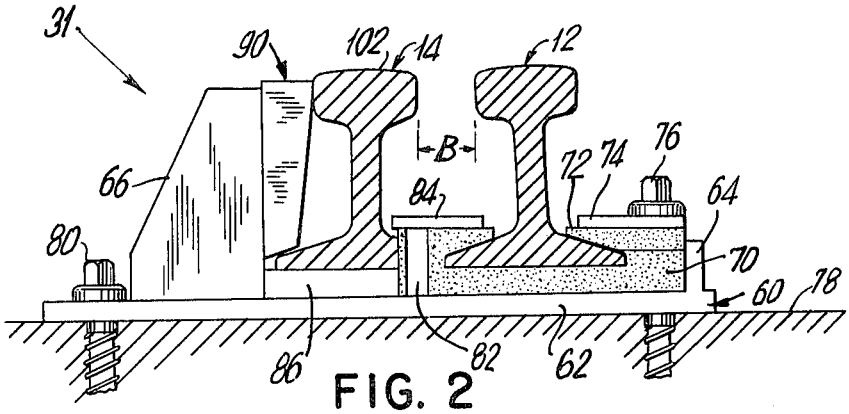
FIG. 2 is a side elevational view, partially in section, of the guarded low rail fastener assembly of the subject invention, as used in tracks with a guarded rail installation.
Figure 3:
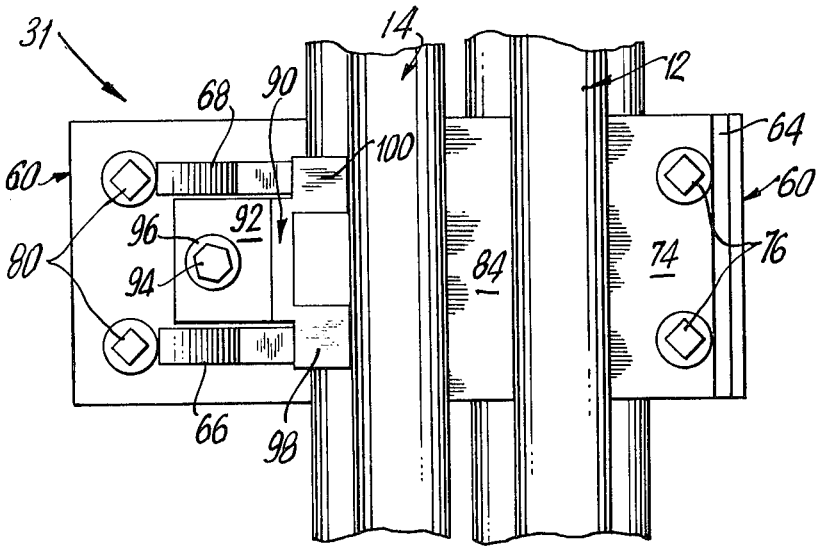
FIG. 3 is a top view of the rail fastener assembly of the subject invention as illustrated in FIG. 2.

The second embodiment of the rail fastener assembly 31 of the subject invention is illustrated in FIGS. 2 and 3, and is intended for use with the paired low, load carrying rail 12 and guard rail 14. More specifically, in this embodiment, the base plate 60 is wider than the base plate 32 of the first embodiment of the subject invention to accommodate both the load carrying and guard rails 12, 14. The base plate 60 includes a planar base portion 62 and an upstanding shoulder 64 disposed at one end thereof. A pair of brace plates 66 and 68 similar to those associated with the first embodiment are provided at the opposed end of the brace plate 60. An elastomeric pad 70 is interposed between the upper surface of the base portion 62 and the load carrying rail 12 to provide the resiliency necessary for reducing noise and vibration.

Similar to the first embodiment, an end cover plate 72 and a steel stiffener plate 74 are provided to maintain the rail 12 within the base plate 60. A pair of 7 inch lag screws 76 pass through the steel stiffener plate 74, the end cover plate 72 and through the base plate 60 and are secured within the substrate 78. A pair of 5 inch lag screws 80 are provided on the opposed end of the base portion 62 and are also secured to the substrate 78. As noted above, the lag screws 78, 80 are for securing the assembly 31 to the substrate which may be, for example, wooden cross ties, concrete pads or decks.

The rail fastener assembly 31 further includes a vertical stud 82 welded to the base portion 62, and disposed between the load carrying rail 12 and the guard rail 14. A center chair plate 84 is welded to the top of the vertical stud. The stud 82 and chair plate 84 function to lock the other side of rail 12 in place thereby maintaining its vertical stability. Further, the studs 82 and chair plate 84 aid in maintaining the space between the guard and load carrying rails 14, 12. The spacing between the rails (or flangeway as indicated at B in FIG. 1), is typically either 2 inches or $2\frac{1}{4}$ inches in width. A spacer bar 86 is provided and is disposed between the upper surface of the base portion 62 and the lower surface of the guard rail 14. The spacer bar 86 is provided to elevate the guard rail 14 to a height equal to the load carrying rail 12. The spacer bar 86 is welded to the base plate 60.

In accordance with the subject invention, wedge 90 is provided and is interposed between the brace plates 66, 68 and the guard rail 14. The wedge 90 includes a horizontal plate portion 92, which is fitted between the spaced brace plates 66, 68 and is bolted to the base plate 60, via cap screw 94 and washer 96. The wedge 90 further includes an upstanding vertical portion composed of two spaced tapered segments 98 and 100 which are fitted between and in abutting relationship with the upper ball or head portion 102 of guard rail 14 and the vertical edges of the brace plates 66 and 68 respectively. The wedge 90 functions to transmit the centrifugal forces exerted on the guard rail 14 through the tapered segments 98, 100, the brace plates 66, 68 and into the base plate 60. More specifically, the pair of vertical portions 98 and 100 of wedge 90 are interposed and in abutting relationship with the head 102 of the rail 14 and the brace plates 66, 68, such that any centrifugal forces tending to cause the overturning of rail 14 are directly transmitted through the wedge and brace plates and into the substrate 78.

The wedge 90, which is operative to transfer the centrifugal forces of the rolling stock into the substrate, will also permit the adjustment, removal, or replacement of the guard rail 14 without disturbing the position of the load carrying rail 12. More specifically, the wedge may be disconnected from the base plate 60 simply by removing cap screw 94 enabling the adjustment and/or replacement of the guard rail 14.

Another significant advantage of the subject invention is that the adjustment of the position of the guard rail 14 is simplified by using a wedge 90 of a specific width. More specifically, the wedge 90 will typically have a thickness of $1\frac{7}{8}$ inches for a 2 inch flangeway, and a $1\frac{5}{8}$ inch thickness for a $2\frac{1}{4}$ inch flangeway. Thus, the use of the wedge 90 in between the brace plates 66, 68 and the guard rail facilitates the adjustment of the position of the guard rail 14.

Figure 6:
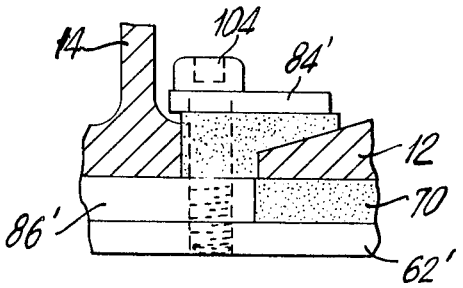
FIG. 6 is an exploded cross sectional view of an alternate embodiment of the spacer bar connections used to maintain the separation or flangeway between the guard rail and load carrying rail as illustrated in FIG. 2.

FIG. 6 is provided to illustrate an alternative arrangement for the spacer bar 86 and chair plates 84 of the second embodiment of the subject invention. More particularly, spcer bar 86' is extended in width such that it just clears the base of the load carrying rail 12. In this embodiment, the vertical stud 82 is eliminated and the chair plate 84' is bolted to both the spacer bar 86' and the base portion 62' by cap screw 104. This latter arrangement wherein the chair plate 84' is readily removable, facilitates the adjustment of the clamping force on the flange of the load carrying rail 12.

In summary, the rail fastener assembly of the subject invention provides an improved means for preventing the overturning of the rails under the centrifugal force imparted by the rolling stock through the wheels thereof. More specifically, the rail fastener assembly as used with a curved, load carrying superelevated rail comprises a unitary base plate having a planar base portion and an upstanding shoulder disposed on one side thereof and a pair of spaced, generally planar upstanding brace plates and disposed on the other side thereof. The brace plates are formed integrally with the base portion and are disposed transverse to the longitudinal axis of the rail. An electromeric pad is positioned between the upper surface of the base portion and the bottom of the rail to provide a resilient seat for the rail to reduce noise and vibration. In accordance with the subject invention, the planar parallel vertical brace plates are disposed in abutting relationship with the head portion of the load carrying rail to prevent the rail from overturning. The rail fastener assembly of the subject invention is a sturdy, integral unit which reduces the likelihood of breakdown and reduces noise and vibrations. In an alternative embodiment for use in conjunction with the paired load carrying and guard rail combination, a wedge means is provided which is interposed between the brace plates and the guard rail for preventing the overturning of the guard rail by dissipating the centrifugal forces imposed on the guard rail by the wheels of the rolling stock. The wedge means is removable to facilitate the adjustment or removal of the guard rail.

The present invention has been described in the above specification with reference to specific embodiments, and such reference has been made for purely illustrative purposes and various modifications could be devised without departing from the scope or spirit of the subject invention as defined by the appended claims.

What is claimed is:

1. A resilient rail fastener assembly for a paired load carrying and parallel guard rail combination, said assembly comprising:

a one-piece base plate adapted to receive said load carrying and guard rails and having a planar base portion, said base plate further including an upstanding shoulder disposed at one end of said base portion adjacent said load carrying rail, said base plate further including a pair of integrally formed spaced, generally planar upstanding brace plates disposed in parallel relationship on the opposed end thereof adjacent said guard rail and oriented transverse to the longitudinal axis of the length of said rails;

an elastomeric pad positioned between the upper surface of said base portion and the bottom of said load carrying rail; and wedge means interposed between said brace plates and said guard rail, said wedge means including an upstanding portion and a horizontal portion, said upstanding portion of said wedge means including two spaced tapered segments, each segment being disposed between said guard rail and one of said brace plates, said horizontal portion of the wedge means being fixedly connected to the base portion of said base plate with the upstanding portion of said wedge means being in abutting relationship with the upper portion of said guard rail such that the centrifugal forces imparted to said curved guard rail by rolling stock moving therealong is transferred from said guard rail through said wedge means and said brace plates into said base portion whereby said guard rail is maintained in a vertical orientation and noise and vibration are substantially reduced.

2. A rail fastener assembly as recited in claim 1, further including a spacer bar disposed between the upper surface of said base portion of said base plate and the bottom of said guard rail.

3. A rail fastener assembly as recited in claim 2 further including a horizontal chair plate removably connected to said spacer bar to adjust the clamping force on said load carrying rail.

4. A rail fastener assembly as recited in claim 1 further including a vertical stud fixedly connected to said base portion of said base plate and positioned between said load carrying rail and said guard rail, said vertical stud for maintaining the spacing between said rails.

5. A rail fastener assembly as recited in claim 4 further including a horizontal chair plate fixedly connected to the top of said vertical stud to maintain the vertical stability of said load carrying rail.

* * * * *